US010894285B2

(12) United States Patent
Li et al.

(10) Patent No.: US 10,894,285 B2
(45) Date of Patent: Jan. 19, 2021

(54) RIVET GUN

(71) Applicant: NANNING FUGUI PRECISION INDUSTRIAL CO., LTD., Nanning (CN)

(72) Inventors: Ri-Meng Li, Nanning (CN); Chiung-Hsu Hsueh, Hsinchu (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 91 days.

(21) Appl. No.: 16/256,079

(22) Filed: Jan. 24, 2019

(65) Prior Publication Data

US 2020/0122223 A1 Apr. 23, 2020

(30) Foreign Application Priority Data

Oct. 18, 2018 (CN) ..... 2018 1 1218088

(51) Int. Cl.
*B21J 15/22* (2006.01)
*B21J 15/32* (2006.01)
*B21J 15/10* (2006.01)

(52) U.S. Cl.
CPC ..... *B21J 15/22* (2013.01); *B21J 15/105* (2013.01); *B21J 15/32* (2013.01)

(58) Field of Classification Search
CPC ..... B21J 15/04; B21J 15/043; B21J 15/045; B21J 15/06; B21J 15/10; B21J 15/105; B21J 15/16; B21J 15/22; B21J 15/041
See application file for complete search history.

(56) References Cited

U.S. PATENT DOCUMENTS 4,597,263 A * 7/1986 Corbett ..... B21J 15/022 29/243.525
4,903,522 A * 2/1990 Miller ..... B21J 15/326 29/243.525
7,062,843 B1 * 6/2006 Lin ..... B21J 15/043 29/243.525
7,290,317 B2 * 11/2007 Kato ..... B21J 15/043 29/243.521

FOREIGN PATENT DOCUMENTS

| | | |
|---|---|---|
| CN | 102527907 | 7/2012 |
| CN | 205270710 | 6/2016 |
| CN | 106903258 | 6/2017 |
| TW | 228742 | 8/1994 |
| TW | M303069 | 12/2006 |
| TW | M559211 | 5/2018 |

* cited by examiner

*Primary Examiner* — Matthew Katcoff
(74) *Attorney, Agent, or Firm* — ScienBiziP, P.C.

(57) ABSTRACT

A rivet gun includes a gun body and a spear detachably connected. The gun body has an axial negative pressure air chamber and an axial hydraulic chamber intercommunicating for gas pressure. The spear includes a connecting chamber communicating with the hydraulic chamber and a gun nozzle. A jaw chamber operating for nail-clamping purposes is adjacent to the gun nozzle. The hydraulic chamber has a piston and an elastic member attached to the piston, other end of the elastic member connecting to the negative pressure air chamber. The piston is coupled to a rod, the rod bears on the jaw chamber to move along the axis of the connecting chamber and thereby clamp on or release a riveting nail.

10 Claims, 11 Drawing Sheets

RIVET GUN

FIELD

The subject matter herein generally relates to a rivet gun.

BACKGROUND

Rivet guns are used for fastening various pieces of metal. When the rivet gun is operated, the gun nozzle is manually suck against the nail rod under a vacuum negative pressure, and then rivets. However, manual suction on the nail consumes physical strength, has low efficiency, and is not suitable for being automated.

Therefore, there is room for improvement within the art.

BRIEF DESCRIPTION OF THE DRAWINGS

Implementations of the present technology will now be described, by way of embodiments, with reference to the attached figures.

DETAILED DESCRIPTION

Figure 1:
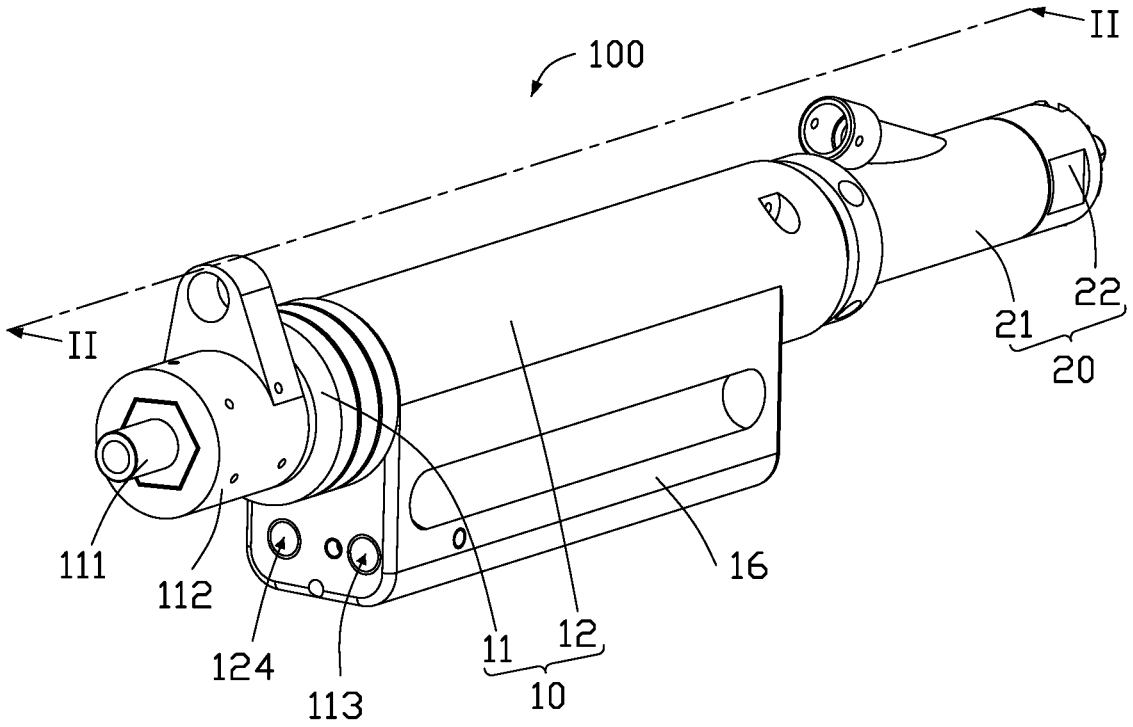
FIG. 1 is an assembled, isometric view of a rivet gun in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "substantially" is defined to mean essentially conforming to the particular dimension, shape, or other feature that the term modifies, such that the component need not to be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

Figure 2:
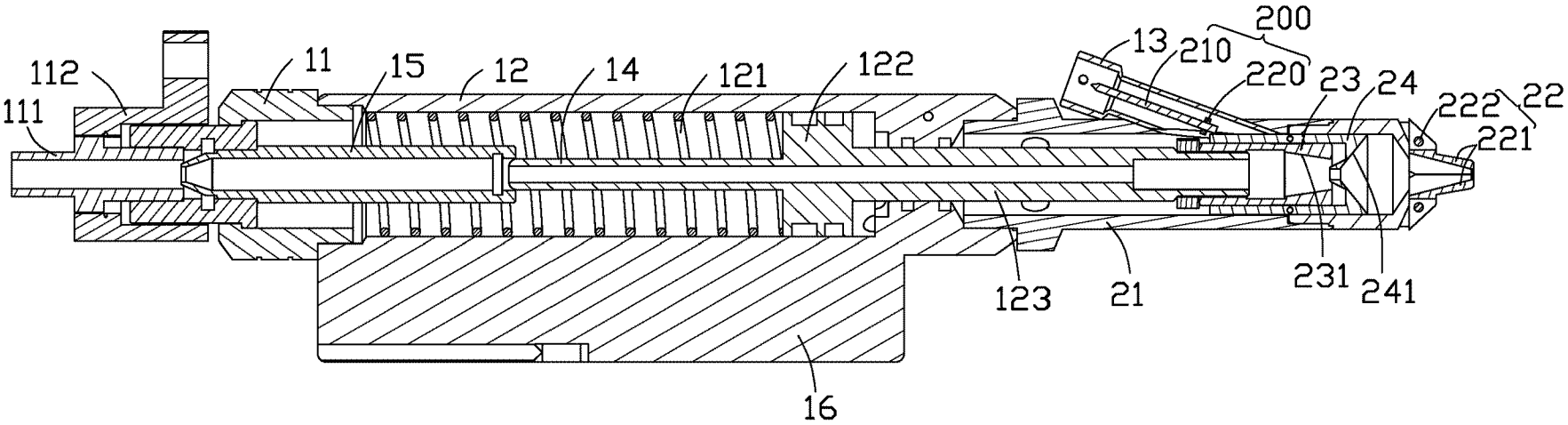
FIG. 2 is a sectioned view along line II-II of FIG. 1.

Referring to FIG. 1 and FIG. 2, a rivet gun 100 of an embodiment in the present disclosure includes a gun body 10 and a spear 20. The gun body 10 and the spear 20 are co-axially arranged an axis. The gun body 10 has a negative pressure air chamber 11 and a hydraulic chamber 12 distributed along the axis of the gun body. The negative pressure air chamber 11 and the hydraulic chamber 12 communicate with each other. The spear 20 is detachably connected with the gun body 10. The spear 20 includes a connecting chamber 21 and a gun nozzle 22 connected with the connecting chamber 21. The connecting chamber 21 communicates with the hydraulic chamber 12.

The connecting chamber 21 further includes a jaw chamber 23 adjacent to the gun nozzle 22. The jaw chamber 23 is around an axis of the connecting chamber 21. The hydraulic chamber 12 is provided with an elastic member 121 and a piston 122 therein. Opposite ends of the elastic member 121 connect to the negative pressure air chamber 11 and the piston 122. When the hydraulic chamber 12 is fed with hydraulic oil, the piston 122 moves towards the negative pressure air chamber 11, and the piston 122 presses the elastic member 121 towards the negative pressure air chamber 11. When hydraulic oil is released from the hydraulic chamber 12, a pressing force of the piston 122 bearing on the elastic member 121 fades away, and the elastic member 121 restores to push the piston 122 to move towards the spear 20.

An end of the piston 122 that faces the spear 20 is coupled to a rod 123. The rod 123 extends towards the gun nozzle 22 and further extends into the jaw chamber 23. The jaw chamber 23 is driven by the rod 123 to move along the axis of the connecting chamber 21. In an embodiment, the elastic member 121 is a spring, and the jaw chamber 23 is made of elastic materials, such as rubber.

A float joint 24 is provided between the jaw chamber 23 and the connecting chamber 21. The float joint 24 is movable along with the jaw chamber 23. The float joint 24 defines a cone portion 241 facing the gun nozzle 22. The cone portion 241 is sunken from a front end of the float joint 24. The jaw chamber 23 has claws 231 for clamping a nail 200. The claws 231 extend from a front end of the jaw chamber 23. When the claws 231 are pressed by the cone portion 241 of the float joint 24 to open, an end of the nail 200 is inserted into the jaw chamber 23 and clutched by the claws 231. When a pressing force of the cone portion 241 bearing on the claws 231 fades away, the claws 231 close and clamp onto a shaft 210 of the nail 200.

In an embodiment, the float joint 24 is configured to ensure that a moving position of the jaw chamber 23 in the connecting chamber 21 does not deviate significantly in a radial direction, so that the claws 231 accurately engage with the nail 200.

Referring to FIG. 2, the connecting chamber 21 communicates with an inlet tube 13. The inlet tube 13 is configured to guide the nail 200 into the spear 20 of the rivet gun 100. A guiding direction of the inlet tube 13 faces the gun nozzle 22. In other words, when the nail 200 is delivered into the connecting chamber 21, a head 220 of the nail 200 faces the gun nozzle 22, and the shaft 210 of the nail 200 faces the gun body 10.

The piston 122 has a hollow channel defined therein. The hollow channel communicates with a first outlet tube 14. The first outlet tube 14 extends along an axis of the elastic member 121. The negative pressure air chamber 11 has a second outlet tube 15 defined therein. The negative pressure air chamber 11 and the hydraulic chamber 12 communicate by means of the second outlet tube 15. The second outlet tube 15 communicates with the negative pressure air chamber 11 by microvoids. In the hydraulic chamber 12, the first outlet tube 14 communicates with the second outlet tube 15. The shaft 210 can exit through the first outlet tube 14 and the second outlet tube 15.

The shaft 210 exits from a tail portion of the rivet gun 100. An inner structure of the rivet gun 100 provides a communication between the piston 122 and the rod 123 (the piston 122 and the rod 123 both have a hollow channel), a communication between the piston 122 and the first outlet tube 14, and a communication between the rod 123 and the jaw chamber 23.

When the first outlet tube 14, the second outlet tube 15, the hollow channel of the piston 122, the hollow channel of the rod 123, and the jaw chamber 23 are all evacuated, the negative pressure air chamber 11 is outwardly coupled with an outlet pipe 111. After the gas in the negative pressure air chamber 11 is taken out from the outlet pipe 111 through the second outlet tube 15, the second outlet tube 15 is under a negative pressure state, and the shaft 210 exits from the second outlet tube 15 because of pressure difference.

Figure 3:
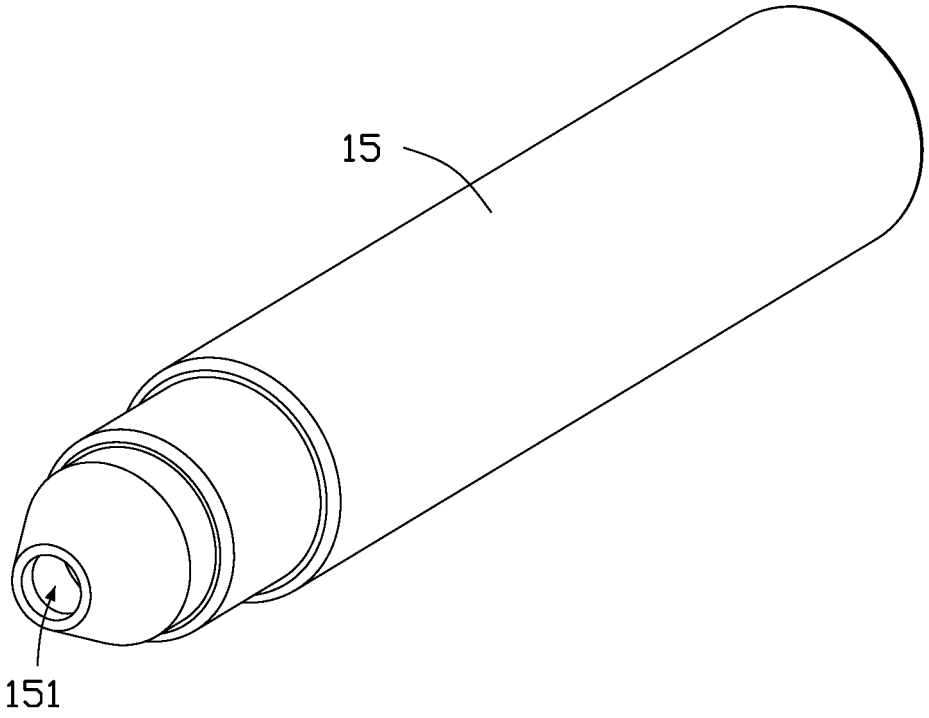
FIG. 3 is an assembled, isometric view of a second outlet tube of the rivet gun in FIG. 2.

The outlet pipe 111 is provided with a control valve 112. The control valve 112 is configured to adjust gas pressure in the negative pressure air chamber 11. As shown in FIG. 2 and FIG. 3, the second outlet tube 15 communicates with the outlet pipe 111. An end of the second outlet tube 15 which is connected with the outlet pipe 111 is cone shaped. An outlet hole 151 is defined on the cone shaped end of the second outlet tube 15. The nail 200 exits from the outlet hole 151 and is expelled out of the gun body 10 through the outlet pipe 111. The cone shaped end of the second outlet tube 15 results in an increase in throttling loss and an increase in pressure difference of the gas during the flow process, so promoting the expelling of the nail 210.

Referring to FIGS. 1-2 and 4-6, in an embodiment, the hydraulic chamber 12 has a piping unit 16 protruding in the radial direction of the hydraulic chamber 12. The piping unit 16 is along an axial direction of the hydraulic chamber 12. The piping unit 16 is provided with an inlet pipe 113 and a hydraulic pipe 124 therein.

The inlet pipe 113 allows gas into the negative pressure air chamber 11, and gas in the negative pressure air chamber 11 is taken out from the outlet pipe 111. A gas flow path exits along the inlet pipe 113, the negative pressure air chamber 11, the second outlet tube 15, and the outlet pipe 111.

The hydraulic pipe 124 forces hydraulic oil in or out of the hydraulic chamber 12 for creating reciprocating motion of the piston 122. Specifically, referring to FIGS. 4-6, an inlet of the inlet pipe 113 and an inlet of the hydraulic pipe 124 are located at a same side of the piping unit 16 adjacent to the negative pressure air chamber 11; an outlet of the inlet pipe 113 is located at a side of the negative pressure air chamber 11 which connects to the hydraulic chamber 12; and an outlet of the hydraulic pipe 124 is located at a side of the hydraulic chamber 12 adjacent to the spear 20.

Since a diameter of the cap 230 of the nail 200 is larger than a diameter of the shaft 210, an open diameter of the gun nozzle 22 when the cap 230 passes through the gun nozzle 22 is larger than an open diameter of the gun nozzle 22 when the shaft 210 passes through the gun nozzle 22. In other words, during an automatic riveting process, the open diameter of the gun nozzle 22 is changed. The gun nozzle 22 can be automatically opened or closed according to the required diameter.

Figure 6:
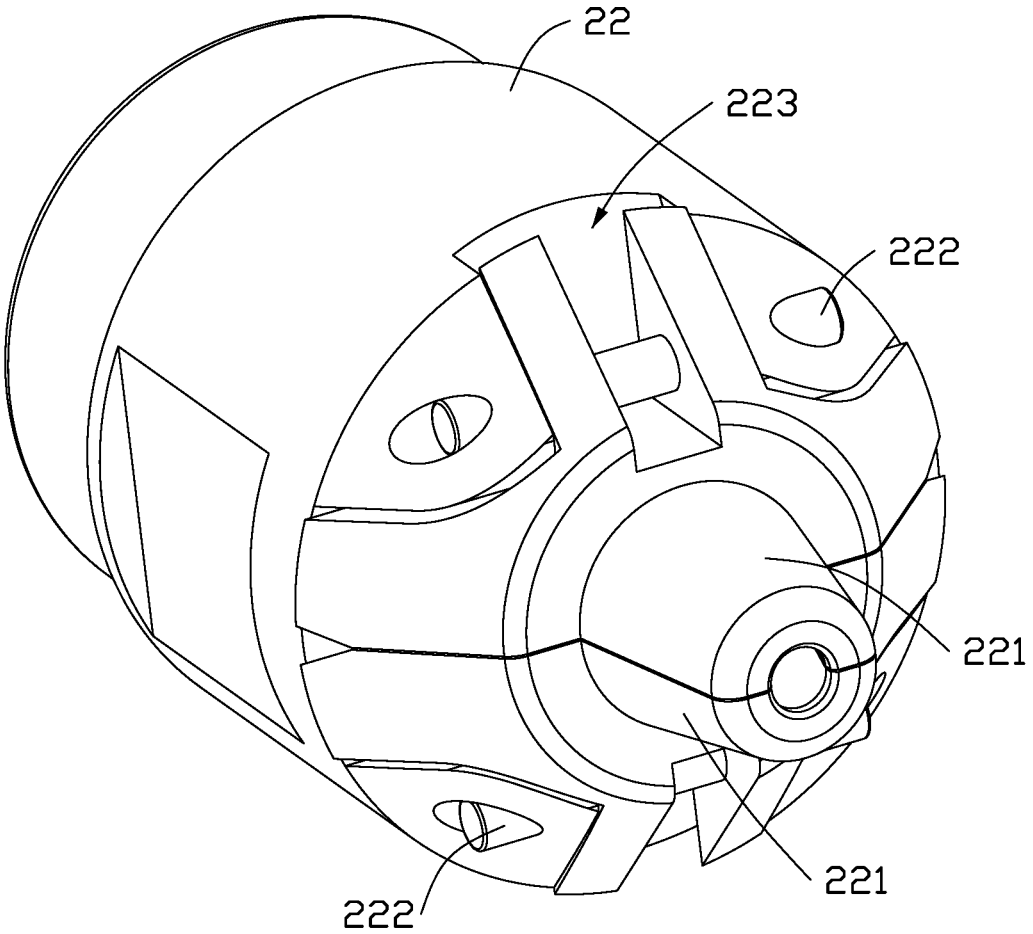
FIG. 6 is an assembled, isometric view of a gun nozzle of the rivet gun in FIG. 2.

In an embodiment, as shown in FIG. 6, the gun nozzle 22 includes at least two nozzle portions 221. The nozzle portions 221 are annularly distributed to collectively define the gun nozzle 22. Each nozzle portion 221 is connected to a periphery of the spear 20 by an elastic shaft 222. Avoiding grooves 223 are defined on the periphery of the spear 20. Each avoiding groove 223 is corresponding to one of the nozzle portions 221. The avoiding grooves 223 are configured to give way to the nozzle portions 221 when the gun nozzle 22 is opened. When the gun nozzle 22 is pressed by the nail 200, the nozzle portions 221 are opened by the elastic shafts 222 to increase the open diameter of the gun nozzle 22. When the gun nozzle 22 loses pressure, the elastic shafts 222 are restored, and the gun nozzle 22 is closed.

FIGS. 7-11 show the rivet gun 100 in different states during operation.

Figure 4:
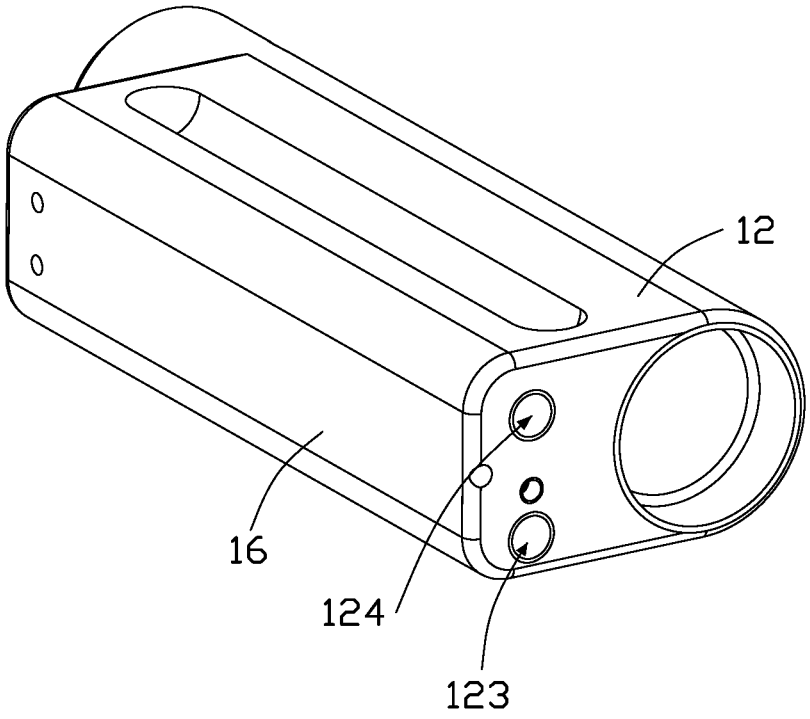
FIG. 4 is an assembled, isometric view of a hydraulic chamber of the rivet gun in FIG. 2.
Figure 5:
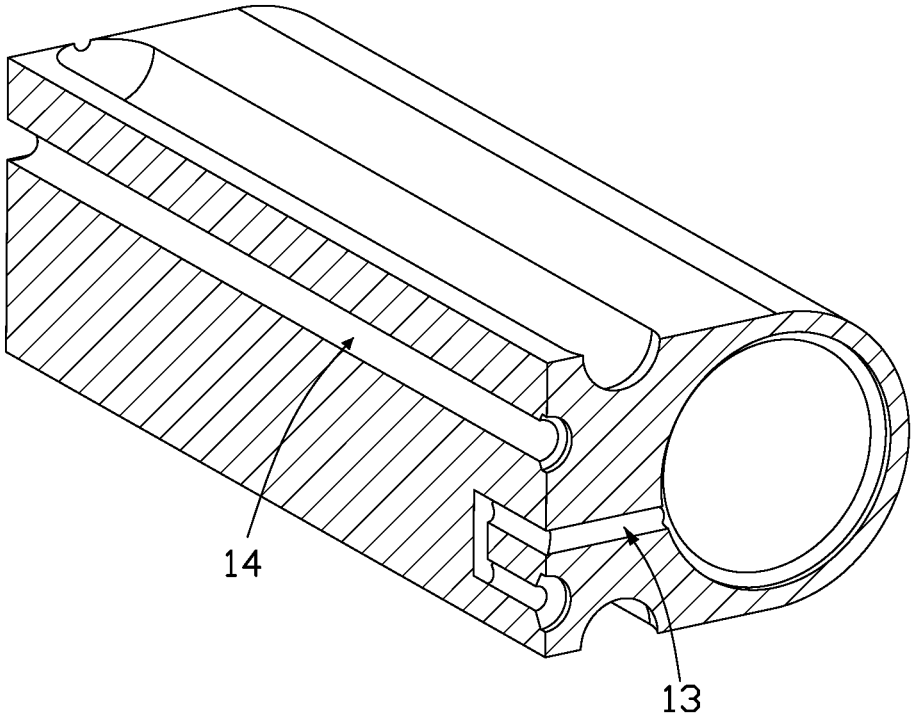
FIG. 5 is sectioned view of part of the hydraulic chamber in FIG. 4.
Figure 7:
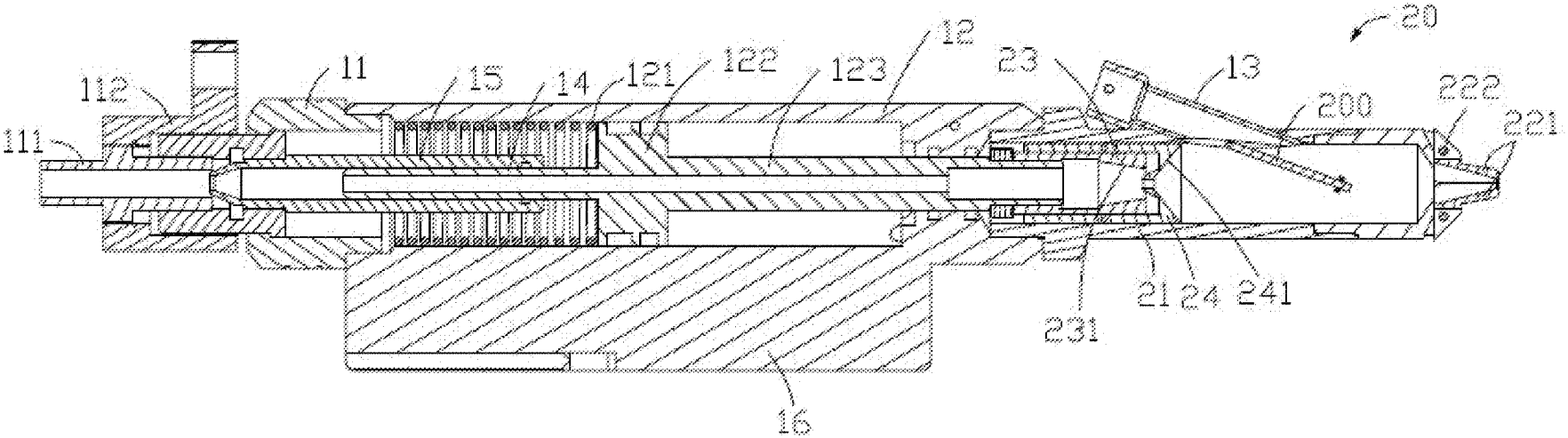
FIG. 7 is a sectioned view of the rivet gun in FIG. 2 loaded with a nail.

FIG. 7 shows a process of the rivet gun 100 loading a nail 200. Hydraulic oil is fed into the hydraulic chamber 12 by the hydraulic pipe 124 (as shown in FIG. 4), and the piston 122 moves towards the negative pressure air chamber 11 under a pressure of the hydraulic oil. The jaw chamber 23 and the float joint 24 are driven by the piston 122 to move far away from the spear 20. After the float joint 24 moves away from the spear 20, a cavity of the connecting chamber 21 of the spear 20 is empty, and a nail 200 is guided into the cavity of the connecting chamber 21 from the inlet tube 13, the head 220 of the nail 200 facing the gun nozzle 22.

Figure 8:
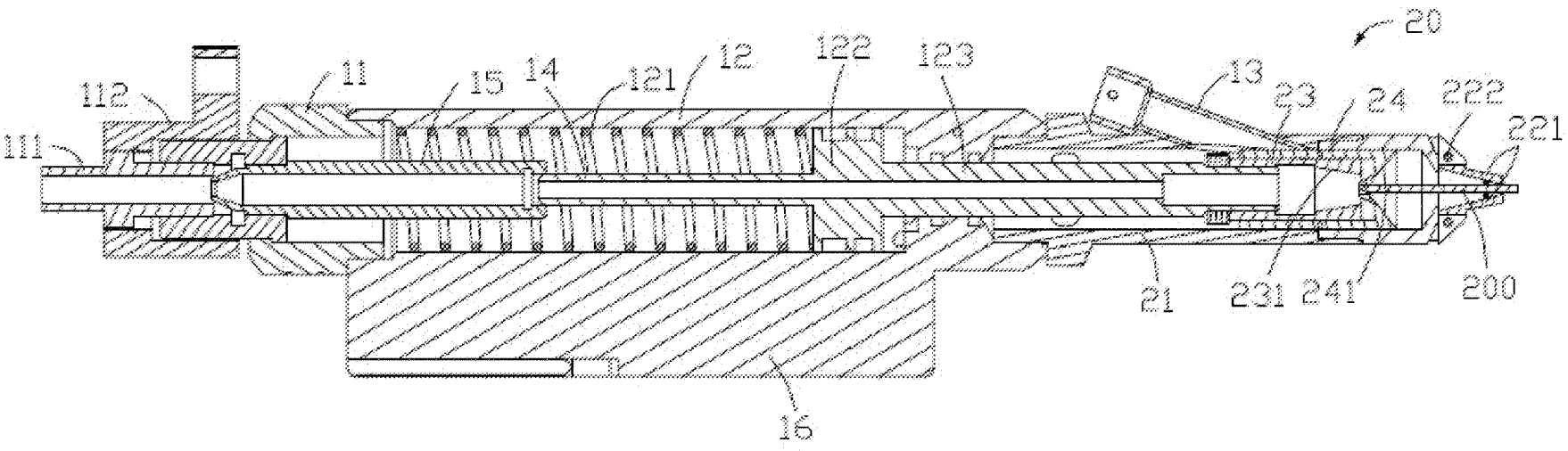
FIGS. 8-10 are sectioned views of the rivet gun in FIG. 2 in different states when being operated.
Figure 9:
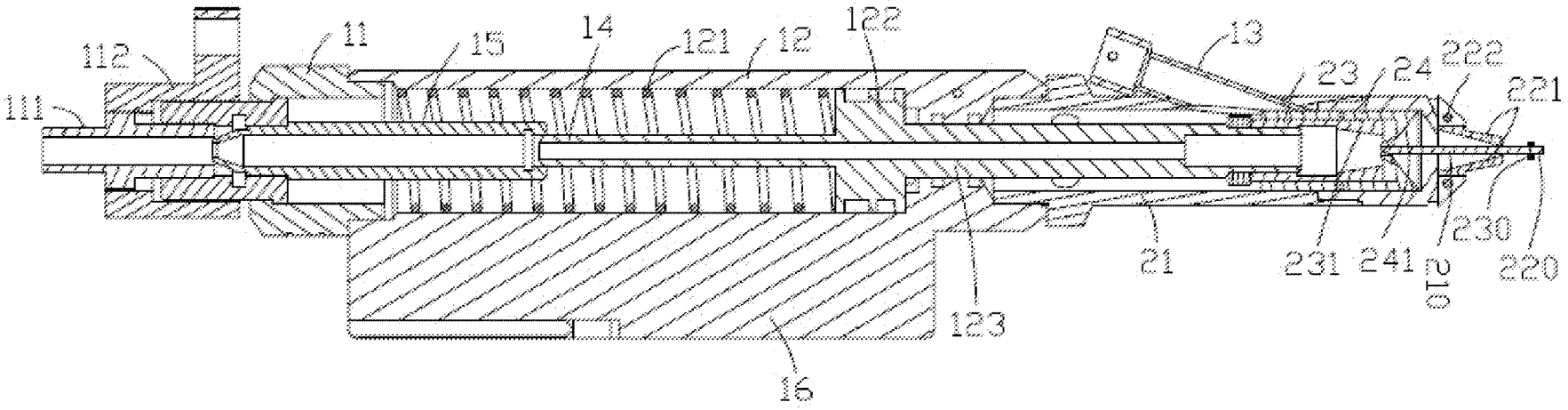
Figure 10:
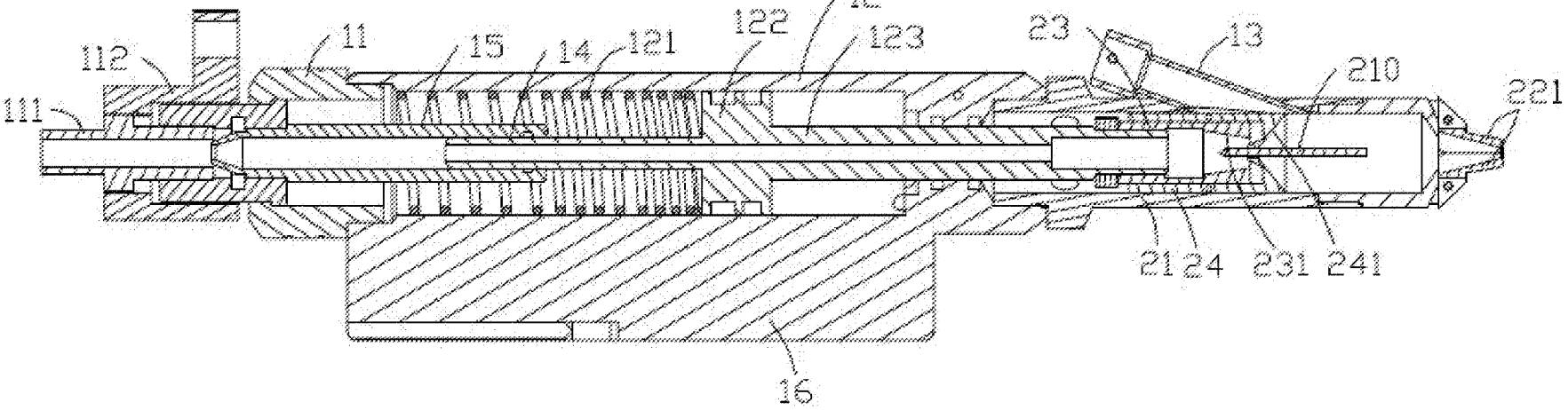

FIGS. 8-10 show a riveting process of the rivet gun 100.

After the nail 200 is delivered into the spear 20, the hydraulic chamber 12 removes the hydraulic oil. When the elastic member 121 accordingly restores, the piston 122 is driven by the elastic member 121 to move towards the spear 20. The jaw chamber 23 and the float joint 24 are driven by the piston 122 to move towards the spear 20 to equalize or decrease the vacuum of the connecting chamber 21 of the spear 20. As the vacuum of the connecting chamber 21 is decreased, the nail 200 abuts against the claws 231 along the outer side of the cone portion 241 of the float joint 24 (as shown in FIG. 8).

The head 220 of the nail 200 is ejected out of the gun nozzle 22 under a continued pushing of the piston 122, and the float joint 24 abuts against a front head of the spear 20. As the piston 122 is pushed again, the float joint 24 gets stuck, the cone portion 241 of the float joint 24 resists the claws 231, the claws 231 are pressed by the cone portion 241 to open, the shaft 210 of the nail 200 is clamped by the claws 231, and the head 210 and the cap 230 of the nail 200 are ejected out of the gun nozzle 22 (as shown in FIG. 9).

Hydraulic oil is again forced into the hydraulic chamber 12, the piston 122 moves towards the negative pressure air chamber 11 under a pressure of the hydraulic oil, and the claws 231 are driven by the piston 122 to move away from the spear 20. The claws 231 are beyond the resistance of the cone portion 241 of the float joint 24 and close to clamp onto the shaft 210. The shaft 210 is driven by the claws 231 to move away from the spear 20, and the head 220 of the nail 200 is disconnected to complete the riveting process (as shown in FIG. 10).

Figure 11:
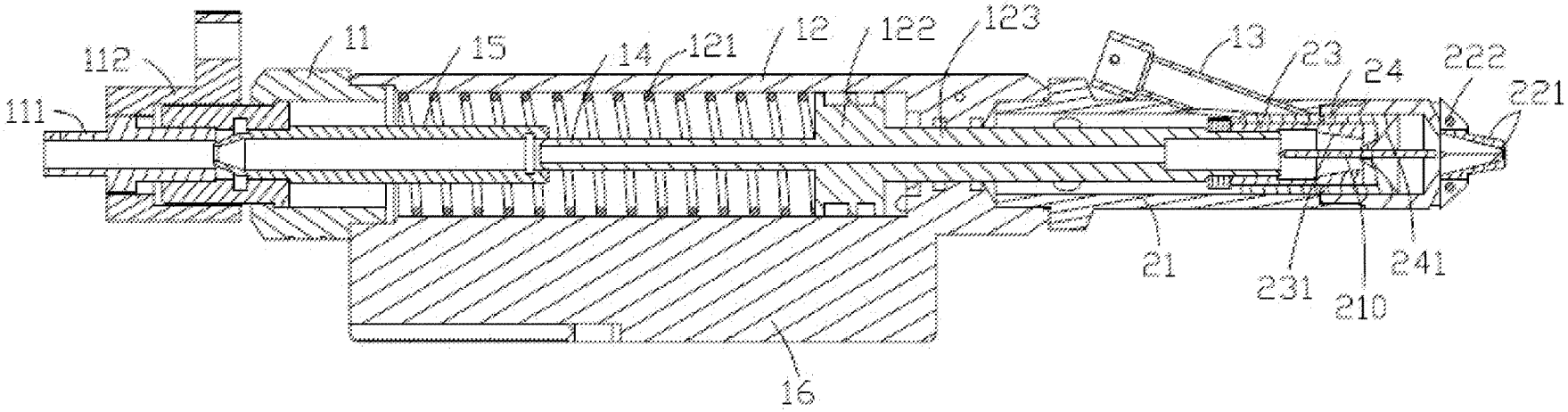
FIG. 11 is a sectioned view of the rivet gun in FIG. 2 expelling a nail.

FIG. 11 shows a process of the rivet gun 100 expelling the shaft 210 of the nail 200. The hydraulic chamber 12 removes the hydraulic oil, gas is allowed into the negative pressure air chamber 11 by the inlet pipe 113, the gas is taken out from the outlet pipe 111 at the same time, and the control valve 112 adjusts the gas outflow amount of the outlet pipe 111 to achieve a suitable pressure difference in the second outlet tube 15. The elastic member 121 is restored to push the piston 122 to move towards the spear 20. The claws 231 are forced open by the cone portion 241 of the float joint 24 to release the shaft 210. At this moment, the first outlet tube 14, the second outlet tube 15, the hollow channel of the piston 122, the hollow channel of the rod 123, and the jaw chamber 23 are all communicated, the shaft 210 is expelled from the second outlet tube 15 under the pressure difference.

The rivet gun 100 of the present disclosure has the negative pressure air chamber 11 and the hydraulic chamber 12 operating simultaneously, to realize automation of the rivet gun 100 in different stages of entering nails, riveting nails, and expelling nails.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A rivet gun, comprising:

a gun body comprising a negative pressure air chamber and a hydraulic chamber co-axially arranged along an axis of the gun body, the negative pressure air chamber and the hydraulic chamber communicating with each other; and a spear detachably connected with the gun body, the spear comprising a connecting chamber communicating with the hydraulic chamber and a gun nozzle connected with the connecting chamber, wherein the connecting chamber comprises a jaw chamber adjacent to the gun nozzle, and the jaw chamber is around an axis of the connecting chamber;

the hydraulic chamber comprises an elastic member and a piston therein, opposite ends of the elastic member are respectively connected to the negative pressure air chamber and the piston;

an end of the piston that faces the spear is coupled to a rod, the rod extends towards the gun nozzle and extends into the jaw chamber, the jaw chamber is driven by the rod to move along the axis of the connecting chamber; and the jaw chamber comprises claws configured for clamping a nail, the claws extend from a front end of the jaw chamber.

2. The rivet gun of claim 1, wherein a float joint is between the jaw chamber and the connecting chamber, the float joint is movable along with the jaw chamber; the float joint defines a cone portion facing the gun nozzle, the cone portion is sunken from a front end of the float joint; when the claws are pressed by the cone portion to open, an end of the nail is inserted into the jaw chamber and clutched by the claws.

3. The rivet gun of claim 1, wherein the connecting chamber communicates with an inlet tube, the inlet tube is configured to guide the nail into the spear, a guiding direction of the inlet tube faces the gun nozzle.

4. The rivet gun of claim 1, wherein the piston comprises a hollow channel defined therein, the hollow channel of the piston communicates with a first outlet tube, the first outlet tube extends along an axis of the elastic member; the negative pressure air chamber comprises a second outlet tube defined therein; the first outlet tube and the second outlet tube communicate to expel a shaft of the nail.

5. The rivet gun of claim 4, wherein the negative pressure air chamber is outwardly coupled with an outlet pipe, the outlet pipe comprises a control valve, the control valve is configured to adjust a gas pressure in the negative pressure air chamber.

6. The rivet gun of claim 5, wherein the second outlet tube communicates with the outlet pipe, an end of the second outlet tube which is connected with the outlet pipe is cone shaped, an outlet hole is defined on the cone shaped end of the second outlet tube, the nail is delivered from the outlet hole and expelled out of the gun body through the outlet pipe.

7. The rivet gun of claim 1, wherein the hydraulic chamber comprises a piping unit protruding in the radial direction of the hydraulic chamber, the piping unit is along an axial direction of the hydraulic chamber; the piping unit comprises an inlet pipe and a hydraulic pipe therein; the inlet pipe is configured to allow gas into the negative pressure air chamber; the hydraulic pipe is configured to force hydraulic oil in or out of the hydraulic chamber.

8. The rivet gun of claim 7, wherein an inlet of the inlet pipe and an inlet of the hydraulic pipe are located at a same side of the piping unit adjacent to the negative pressure air chamber; an outlet of the inlet pipe is located at a side of the negative pressure air chamber which connects the hydraulic chamber; and an outlet of the hydraulic pipe is located at a side of the hydraulic chamber adjacent to the spear.

9. The rivet gun of claim 1, wherein the gun nozzle comprises at least two nozzle portions, the nozzle portions are annularly distributed to collectively define the gun nozzle.

10. The rivet gun of claim 9, wherein each of the nozzle portions is connected to a periphery of the spear by an elastic shaft, avoiding grooves are defined on the periphery of the spear, each of the avoiding grooves is corresponding to each of the nozzle portions, the avoiding grooves are configured to give way to the nozzle portions when the gun nozzle is opened.

* * * * *